US009907443B1

(12) United States Patent
Vinal

(10) Patent No.: US 9,907,443 B1
(45) Date of Patent: Mar. 6, 2018

(54) TOILET SEAT WITH SANITARY LIFTING ELEMENT

(71) Applicant: Zachary Vinal, Syracuse, NY (US)

(72) Inventor: Zachary Vinal, Syracuse, NY (US)

(73) Assignee: Zachary Vinal

( * ) Notice: Subject to any disclaimer, the term of this patent is extended or adjusted under 35 U.S.C. 154(b) by 0 days.

(21) Appl. No.: 15/344,427

(22) Filed: Nov. 4, 2016

Related U.S. Application Data

(60) Provisional application No. 62/254,442, filed on Nov. 12, 2015.

(51) Int. Cl.

| | |
|---|---|
| ***A47K 13/10*** | (2006.01) |
| ***A47K 13/02*** | (2006.01) |
| ***A47K 13/04*** | (2006.01) |
| ***A47K 13/26*** | (2006.01) |

(52) U.S. Cl.
CPC ..... *A47K 13/105* (2013.01); *A47K 13/02* (2013.01); *A47K 13/04* (2013.01); *A47K 13/26* (2013.01)

(58) Field of Classification Search
CPC ..... A47K 13/105; A47K 13/02; A47K 13/04; A47K 13/26; A47K 13/00
USPC ..... 4/241, 234, 237, 246.1
See application file for complete search history.

(56) References Cited

U.S. PATENT DOCUMENTS 1,346,252 A * 7/1920 Rathbone ..... E03D 9/08 4/237
3,783,455 A * 1/1974 Vanderbrook ..... A47K 13/105 16/110.1
4,129,907 A * 12/1978 Vaughan ..... A47K 13/105 16/441
4,285,075 A * 8/1981 Nelson ..... A47K 17/00 4/251.1
5,058,215 A * 10/1991 Sims ..... A47K 13/105 16/443
5,086,523 A * 2/1992 De Mott ..... A47K 13/105 16/421
5,341,519 A 8/1994 Cusenza
5,375,267 A 12/1994 Davis
5,511,252 A * 4/1996 Kreemer ..... A47K 13/105 4/246.1
5,729,839 A * 3/1998 Bigelow ..... A47K 13/105 16/905
6,634,032 B1 * 10/2003 Janik ..... A47K 13/105 4/246.1
6,842,916 B1 1/2005 Gunn et al.
(Continued)

*Primary Examiner* — J. Casimer Jacyna
*Assistant Examiner* — Benjamin R Shaw
(74) *Attorney, Agent, or Firm* — Winston & Strawn, LLP; Allan Fanucci

(57) ABSTRACT

A toilet seat that includes a seat support; a sanitary lifting mechanism securely attached to the lower surface of the seat support, with the lifting mechanism having a handle member that has a rearward portion that is received in the seat support and a forward portion that extends outside of the seat support to facilitate lifting of the seat, and a protective plate member configured and arranged to fit below and within the lower surface of the seat support subjacent the rearward portion of the handle member and extending on both sides thereof to secure the handle member to the seat support; a fastening system for attaching the protective plate member to the lower surface of the seat support; and two or more seat bumpers that minimize contact of the lower surface of the seat support with the toilet bowl.

20 Claims, 3 Drawing Sheets

(56) References Cited

U.S. PATENT DOCUMENTS

| | | | | |
|---|---|---|---|---|
| 6,918,142 | B1 * | 7/2005 | Wainwright | A47K 13/105 16/111.1 |
| 7,272,863 | B2 * | 9/2007 | Pratt | A47K 13/105 4/246.1 |
| 8,132,272 | B1 * | 3/2012 | Esposito | A47K 13/105 4/246.1 |
| 8,402,571 | B1 * | 3/2013 | Pagett | A47K 13/105 292/125 |
| 8,689,367 | B2 | 4/2014 | Nguyen | |
| 2005/0262623 | A1 * | 12/2005 | Holloway | A47K 13/105 4/246.1 |
| 2007/0017014 | A1 * | 1/2007 | Dismuke | A47K 13/105 4/246.1 |
| 2009/0313749 | A1 | 12/2009 | Armstrong | |
| 2011/0067172 | A1 * | 3/2011 | Barnes, Sr. | A47K 13/105 4/246.1 |
| 2011/0197348 | A1 * | 8/2011 | Steadman | A47K 13/10 4/246.1 |
| 2011/0239358 | A1 * | 10/2011 | Mendoza | A47K 13/105 4/246.1 |
| 2012/0047641 | A1 * | 3/2012 | Liang | A47K 13/105 4/246.1 |
| 2013/0283519 | A1 * | 10/2013 | Holden | A47H 23/00 4/558 |

* cited by examiner

TOILET SEAT WITH SANITARY LIFTING ELEMENT

CROSS-REFERENCE TO RELATED APPLICATION

This application claims the benefit of provisional application 62/254,442 filed Nov. 12, 2015, the entire content of which is expressly incorporated herein by reference thereto.

BACKGROUND

The present invention relates to a new and improved toilet seat lifting element that includes a handle that allows the user to lift the seat when desired. The lifting element is designed to prevent or minimize germ growth thereon so that the user can more safely lift the seat without encountering germs or bacteria that would otherwise grow on the handle surface due to its contact with the lower portion of the seat due to contact with human waste.

In the prior art, the desirability of a handle for lifting a toilet seat has been established. Most of the art has been concerned with simply attaching the handle to the seat in a secure but unobtrusive manner. In this regard, one can mention the following U.S. Pat. Nos. 5,341,519, 5,375,267, 5,729,839, 6,842,916, and 8,689,367 and US patent publication 2009/0313749. One problem with the prior art in general is that the handle is not securely attached to the toilet seat such that it can be dislodged or broken off by being stepped upon or kicked by a user. Another problem is that many of these handles are attached to the bottom of the seat which causes the seat to be reconfigured to accept the handle without being conventionally attached to the toilet bowl. Finally, the main problem with most prior art handles is that a variety of germs and pathogens can be transmitted through toilet seats, and in general these germs and pathogens can migrate to the handles of the prior art. For this reason, while the handles are provided to avoid this problem, they are not effective and are not much better than touching the toilet seat with one's hands, which of course many people dislike.

Accordingly, there is a need in the art for a sanitary toilet seat lifting mechanism that overcomes the problems of the art. This is now provided by the present invention.

SUMMARY OF THE INVENTION

The invention relates to a toilet seat comprising a seat support having a top surface and a lower surface and configured to be mounted on a toilet bowl; a sanitary lifting mechanism securely attached to the lower surface of the seat support, with the lifting mechanism comprising a handle member that has a rearward portion that is received in the seat support and a forward portion that extends outside of the seat support to facilitate lifting or lowering of the seat, and a protective plate member configured and arranged to fit below and within the lower surface of the seat support subjacent the rearward portion of the handle member and extending on both sides thereof to secure the handle member to the seat support; a fastening system for attaching the protective plate member to the lower surface of the support with the rearward portion of the handle member situated between the seat support and the protective plate member, and two or more seat bumpers that minimize contact of the lower surface of the seat support with the toilet bowl. The protective plate member and handle member are independently made of metal, an impermeable engineered plastic, treated wood, or a composite material.

The fastening system may include a plurality of screws or rivets; adhesives; a plurality of inserts securely mounted in the seat support and threaded bolts or screws that are received in the inserts; a plurality of threaded bolt shanks projecting from the lower surface of the support and received in openings in the protective plate member and being secured thereto by nuts; welding or another bonding system; hook and loop components, with one attached to the support and one attached to the protective plate member; or spikes or teeth in the protective plate member that are embedded in the seat support.

The seat support typically has a substantially U-shaped configuration, or a full or partial substantially circular or oval shape, and the protective plate member covers at least about 15% to substantially all of the lower surface of the seat support. Preferably, the protective plate member covers at least about 25% to 50% of the lower surface of the seat support. Advantageously, a balancing plate member is provided for covering at least about 25% to 50% of the lower surface of the seat support in an opposed location to the protective plate member so that the seat has a balanced weight to facilitate lifting or lowering of the seat. The protective plate member has a general thickness of between about 0.1 and about 0.35 inches wherein, when the protective plate member is made of metal, the thickness is between about 0.1 and about 0.25 inches, and when the protective plate member is made of plastic, the thickness is between about 0.2 and about 0.35 inches.

The rearward portion of the handle member is received in a slot or channel in the seat support, and the forward portion of the handle member is configured and dimensioned to be larger than the rearward portion to facilitate grasping and lifting or lowering of the seat. The fastening system attaches the protective plate member to the seat support in a manner that securely retains the rearward portion of the handle member in the slot or channel. Alternatively, the protective plate member when made of plastic may be molded onto or as part of the lower surface of the seat support or adhered by a suitable adhesive or by plastic welding with the rearward portion of the handle member positioned and securely held in a slot or channel between the protective plate member and seat support.

In one embodiment, the at least one seat bumper is attached to the seat support and the protective plate member has one or more apertures therein that are sufficiently large to surround each seat bumper to allow each seat bumper to protrude through the plate member. In an alternative embodiment, the protective plate member includes at least one seat bumper mounted thereon. The number of bumpers on the seat support or on the plate member can vary depending upon the desired holding of the seat support. Typically between 2 and 5 bumpers are provided.

In a preferred arrangement, the fastener system comprises a plurality of inserts securely mounted in the support and threaded bolts or screws that are received in the inserts with the bolts or screws each having a security head so that special tools are needed for attaching or detaching the plate members to the arms of the seat support.

The lower surface of the seat support may be substantially flat to facilitate attachment of a substantially flat protective plate member. Instead, the lower surface of the seat support may have a curvature with the protective plate member having a curvature that corresponds to the curvature of the lower surface of the seat support. Preferably, to maintain the original dimensions of the toilet seat, the lower surface of the seat support may include a recess for receiving the protective plate member therein. And if desired, the protective plate member may be configured and dimensioned to conform to the entire lower surface of the seat support.

BRIEF DESCRIPTION OF THE DRAWINGS

Preferred embodiments of the invention will now be described in connection with the appended drawing figures, wherein.

DETAILED DESCRIPTION OF THE PREFERRED EMBODIMENTS

In the description that follows, the term "substantially" is used for its ordinary meaning to indicate when shapes, dimensions or sizes are not precise or exact. A skilled artisan can readily determine what tolerances are acceptable to provide a shape, surface or mating component that can be combined with a conventional or modified seat support. Typically, the term "substantially' will mean that the shapes, surfaces or component dimensions can vary from the specific shape or size mentioned, with the variances being as much as a 5 or 10% although in the more preferred embodiments the variance is less than 5%.

Additionally, all specific dimensions recited herein are approximate and can vary by as much as +10% to in some case ±25%. In some situations, the term "about" is used to indicate this tolerance. And when the term "about" is used before reciting a range, it is understood that the term is applicable to each recited value in the range. Often, the craftsmanship and engineering procedures that are followed in construction of the seats of the invention minimize these tolerances as much as possible or industrially practical.

Figure 1:
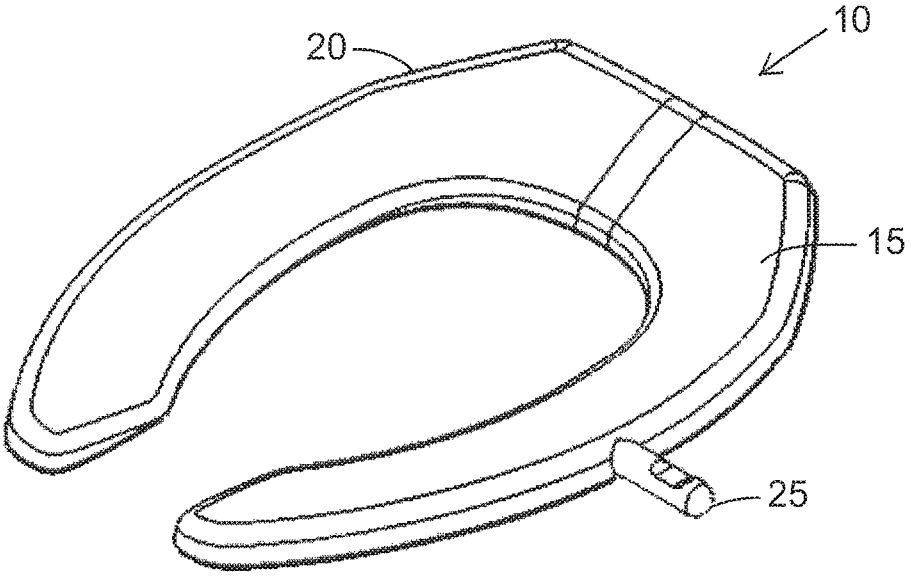
FIG. 1 is a perspective view of the toilet seat of the invention to illustrate the handle member that can be used to lift the seat.

Referring now to the drawings, shown in FIG. 1 shows a toilet seat 10 according to the invention. The seat 10 has a U-shape including right side half 15 and left side half 20. The upper surface of the seat is typically contoured while the lower surface may be flat or contoured. The seat includes a sanitary lifting handle 25 attached to the right side half 15 of the seat. It is understood that the handle 25 can instead be provided on the left side half 20 of the seat or on both sides if desired. Typically, one handle 25 on one side of the seat is sufficient to allow lifting of the seat or lowering of a raised seat without having to touch the seat itself.

Figure 2:
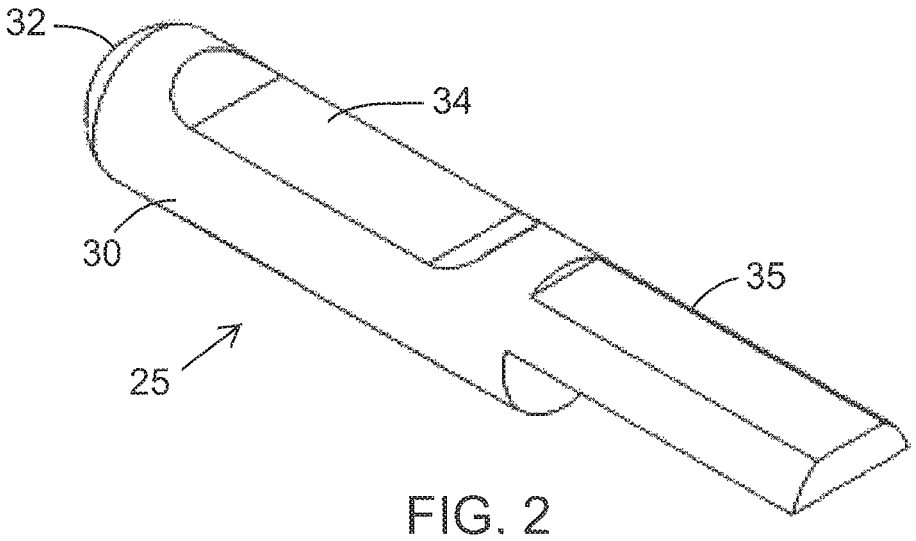
FIG. 2 is a view of the handle member.

FIG. 2 illustrates the handle 25 in further detail. The handle includes a forward portion 30 and rearward portion 35. In a preferred embodiment, the handle 25 is made of machined metal such as stainless steel although it can alternatively be made of a relatively impermeable material such as a moisture impermeable plastic or engineered plastic or of a wood that is chemically treated to resist moisture penetration. Suitable plastic materials include polycarbonates or polyethylene terephthalates or any one of a variety of fiberglass reinforced polymers including epoxies, polyesters or others. These materials have greater resistance to moisture which would foster the growth of germs or bacteria. Metals such as aluminum, a copper based alloy or stainless steel are preferred as they are considered to be non-porous and provide the greatest antimicrobial resistance. Thus, to make the handle it is convenient to start with a cylindrical blank of stainless steel or another metal can be machined into the size and shape of the handle shown in FIG. 2. The forward portion 30 is initially generally cylindrical and has a forward end 32 that is rounded. The top side 34 of the handle includes a chamfered area to facilitate grasping by the user. The chamfer is optional but preferred, as is the rounded forward end. If desired, the entire handle 25 can be a flat rectangular plate but the shape shown in FIG. 2 provides greater resistance to bending or damage. Also, the handle allows the user to raise and lower the seat with never having to touch the seat itself.

The rearward portion 35 of the handle 30 is machined in an upper part of the cylinder to a uniform thickness and having rounded edges that match the curvature of the original cylinder. Of course, the rearward portion 35 of the handle may be machined to have a rectangular shape behind the substantially cylindrical forward portion of as part of a rectangular plate that forms the entire handle. In the preferred embodiment, the curved sides of the rearward portion 35 facilitate its secure placement in a slot or channel in the seat support as described herein.

Figure 3:
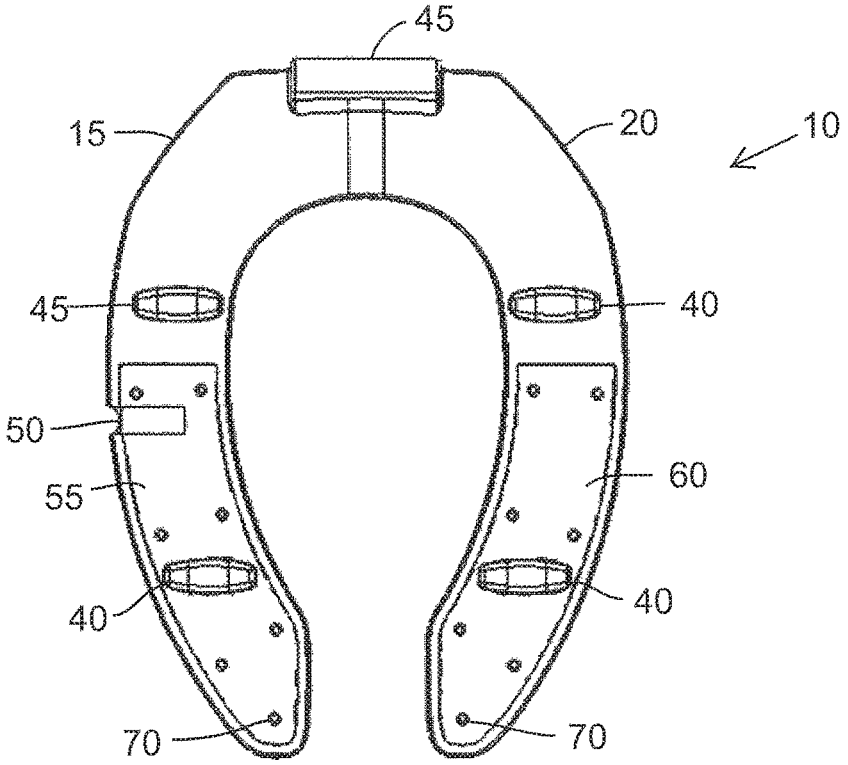
FIG. 3 is a bottom view of the toilet seat support.

FIG. 3 illustrates the lower surface of the seat 10 before attaching the handle member and protective plate member 75 thereto. The lower surface of the seat support includes conventional bumpers 40 which prevent the entire lower surface of the seat from coming into contact with the bowl. The seat 10 also includes a conventional mechanism 45 for mounting the seat onto the bowl. In accordance with the invention, the seat support 10 includes a slot or channel 50 that is configured and dimensioned to conform to rearward portion of the handle so that the rearward portion of the handle can be received and secured in the slot or channel 50.

FIG. 3 also illustrates a pair of recesses 55, 60 that are present on each half 15, 20 of the seat support. These recesses are configured to be of the same shape and depth as the shape and thickness of the protective plate member 75 and balancing plate member 80 that are to be secured to the seat. In configuring or manufacturing the recesses in the seat, in one embodiment, the seat bumpers 40 are not removed and are allowed to remain in place or a mechanism is present to allow attachment of the bumpers to the seat support. In this arrangement, the plate members that are attached to the seat recesses include openings that allow the bumper or bumpers to protrude therethrough. The opening is configured to snugly engage the bumper(s) so that it becomes difficult for splashed liquid to get behind the plate member in the space between the opening and the bumper(s). Alternatively, if the bumpers or bumper supports are removed when the recesses are made, the bumpers can be attached to or form part of the plate members instead. As noted above, the entire seat would have between 2 and 5 bumper members although a greater number can be provided if desired. Typically, there is one bumper in the area where the preferred protective plate member 75 is attached, although there could be 2 or more in other arrangements. FIG. 3 further discloses a number of small openings 70 in the seat support which are provided therein to receive screws or bolts for attachment of the plate members.

FIG. 3 also shows that approximately 50% of the bottom surface of the right half 15 of the U-shaped seat support is covered by the protective plate member 75. This amount of the surface area can vary and can range from at least about 15% of the seat half 15 to substantially all of the lower surface of the right half 15 of the seat support. In a further embodiment, the entire lower surface of the seat support can be provided with a single protective plate member that is configured to be slightly smaller than the seat support and of a thickness that is substantially the same as the height of the walls that surround the recess. The protective plate member 75 minimizes the area of the bottom surface of the seat support that may be subject to contact by human waste or splashing liquid or solids that would otherwise contaminate the bottom surface of the seat support. As disclosed herein, stainless steel or another non-porous material is desired for the protective plate member to resist germ growth beneath the seat. Any of the materials disclosed for the handle are also suitable for use as the protective plate member. Optimally, the protective plate member 75 covers about 25% to 50% of the lower surface of the right half of the seat support. And while the preferred embodiment is shown as a U-shaped seat support, the same type of analysis and coverage of the protective plate member would be used on a round or oval shaped seat support.

Figure 4:
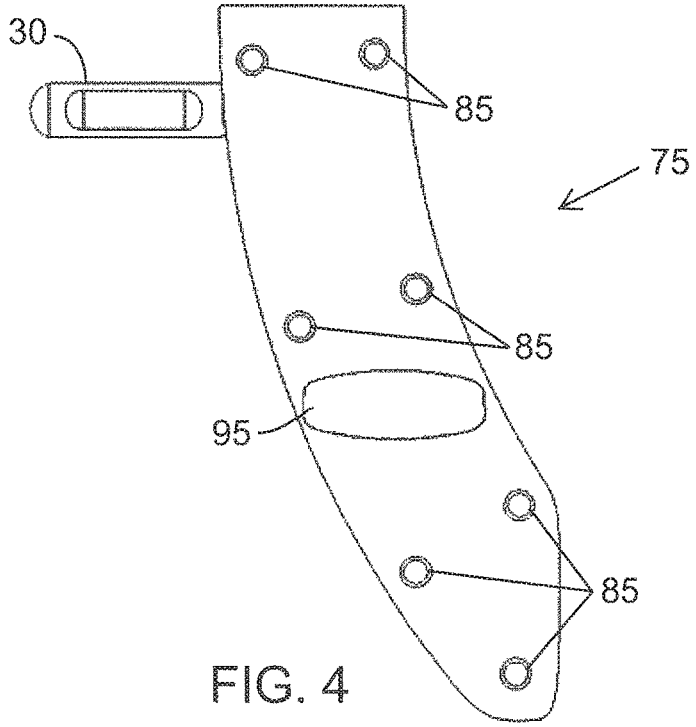
FIG. 4 is a view of the plate member that is used to secure the handle member to the toilet seat support.

FIG. 4 specifically illustrates the protective plate member 75 and shows where the forward portion 30 of the handle would be situated with respect to the plate member 75. The plate member 75 includes a number of openings 85 through which bolts or screws would pass to attach the plate member 75 to the seat in the recess 55. As shown, the plate member 75 also includes a larger opening 95 which would fit over seat bumper 40 and through which the bumper would protrude so that it can contact the upper surface of the toilet bowl when the seat 10 is in the operative position for use. As noted herein, the plate member may be made of any one of a variety of relatively impermeable materials such as a metal, plastic or engineered plastic, or a wood that is chemically treated to resist moisture penetration. It is most preferred that a metal such as aluminum, a copper based alloy or stainless steel be used for plate member 75 as these materials can be provided as a high strength sheet of uniform thickness that can easily be configured to be received in the recess 55. It is to be understood that the invention preferably provides a toilet seat that has the same size as a conventional toilet seat with the handle rearward end 35 located in a slot or channel in the seat and the plate member 75 located within a recess 55. Thus, the seat takes up the same space as a conventional seat so that no special mounting or other concessions need to be made to install it. The seat simply is attached to the bowl in the same manner as a conventional seat and is identical in size except for the protruding forward portion 30 of the handle 25.

Depending upon the material that is used, the protective plate member 75 has a thickness of between about 0.03 and about 0.35 inches. Typically, when the protective plate member 75 is made of metal such as the preferred stainless steel material, the thickness is between about 0.1 and about 0.25 inches and is typically about 1/16 (i.e., about 0.06) inch. When the protective plate member 75 is made of plastic or wood, the thickness may be between about 0.2 and about 0.35 inches. The thickness of the plate member 75 depends to some extent on the thickness of the seat and of course would be selected so that the recess 55 could be configured into the seat without loss of overall strength or support capabilities.

The recess 55 for the protective plate member extends from one end of the U-shaped support and includes a raised wall that surrounds the protective plate member. The openings 85 for the screws or bolts are strategically arranged in the plate member to provide a very secure attachment to the seat support 10, with the plate member extending completely about the rearward portion 35 of the handle so that it can be securely maintained in the slot or channel 50. The attachment is sufficiently strong so that the handle cannot be removed, and this allows users to raise and lower the seat many, many times with never having to touch the seat itself and without concern of germs or pathogens growing on the handle.

For attachment of the protective plate to the seat support, some of the openings are provided further back in the seat support beyond the point where the slot or channel 50 is located, while others are conveniently placed in other areas along or near the perimeter of the plate member 75. Of course, the seat support 10 also has corresponding openings 70 located to be aligned with the openings 85 to facilitate attachment of the plate member 75 within the recess 55. Depending upon the specific type of fastener system, openings 70 may not be necessary.

Figure 5:
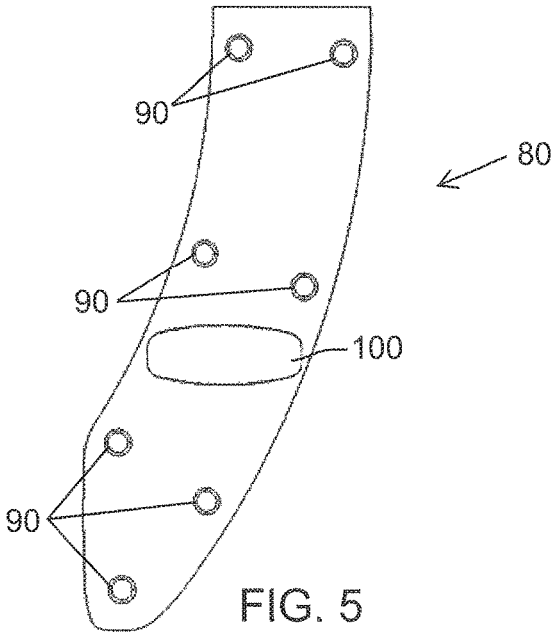
FIG. 5 is a view of the balancing plate member of the invention.

FIG. 5 specifically discloses the balancing plate member 80 which is applied to the left side U-shaped portion 20 of the seat support 10 in recess 60. The recess 60 for the balancing plate member 80 extends from the other end of the U-shaped support and also includes a raised wall that surrounds the balancing plate member. Preferred materials for the balancing plate member would be the same materials that are considered for use as the protective plate member. Like the protective plate member 75 of FIG. 4, the balancing plate member 80 is also made of metal such as the preferred stainless steel material, with the same thickness as the protective plate member, i.e., between about 0.1 and about 0.25 inches and typically about 1/16 (i.e., about 0.06) inch. When the protective plate member 75 is made of plastic or wood, the balancing plate member 80 is made of the same material and has substantially the same thickness, i.e., between about 0.2 and about 0.35 inches.

Approximately 50% of the bottom surface of the left half 20 of the U-shaped seat support is covered by the balancing plate member 80. This amount of the surface area can vary and can range from at least about 15% of the seat half 20 to substantially all of the lower surface of the left half 20 of the seat support. When the entire lower surface of seat support is provided with a single protective plate member, no balancing plate is needed. Like the protective plate member 75, the balancing plate member minimizes the area of the bottom surface of the seat support that may be subject to contact by human waste or splashing liquid or solids that would otherwise contaminate the bottom surface of the seat support. As disclosed herein, stainless steel or another non-porous material is desired for the balancing plate member to resist germ growth beneath the seat. Any of the materials disclosed for the handle and protective plate member are also suitable for use as the balancing plate member. Optimally, the balancing plate member 75 covers about 25% to 50% of the lower surface of the left half 20 of the seat support. And while the preferred embodiment is shown as a U-shaped seat support, the same type of analysis and coverage of the balancing plate member would be used on a round or oval shaped seat support.

As with the protective plate member 75, the balancing plate member 80 and the recess 60 are configured to maintain the plate member in the seat without changing the size of the seat or losing or compromising its overall strength or support capabilities. By configuring the balancing plate member 80 in substantially the same manner, size and thickness as the protective plate member, the seat is maintained with a generally balanced weight to facilitate lifting or lowering of the seat 10. And like the protective plate member 75, the balancing plate member 80 also includes a larger opening 100 which would fit snugly over seat bumper 40 and through which the bumper would protrude so that it can contact the upper surface of the toilet bowl when the seat 10 is in the operative position for use. And further, if the bumper is removed from the seat support, a separate bumper or bumpers can be provided on the balancing plate member itself.

Balancing plate member 80 also includes openings 90 for the screws or bolts with the openings strategically arranged in the plate member to provide a very secure attachment to the seat support 10. The openings are conveniently provided in areas along or near the perimeter of the plate member 80. Of course, the seat support 10 also has corresponding openings 70 located to be aligned with the openings 90 to facilitate attachment of the plate member 80 within the recess 60. Depending upon the specific type of fastener system, openings 70 may not be necessary beneath the balancing plate member.

According to a preferred embodiment of the invention, the fastener system for both the protective plate member 75 and the balancing plate member 80 comprises a plurality of inserts securely mounted in the holes 70 of the seat support. These inserts receive threaded bolts or screws that each have a security head so that special tools are needed for attaching or detaching the plate members to the arms of the seat support. The security head can be any of the conventional shapes or configurations that do not accept a Philips or flat screwdriver head and thus provides a secure, tamper resistant connection of the plate member to the seat support.

Figure 6:
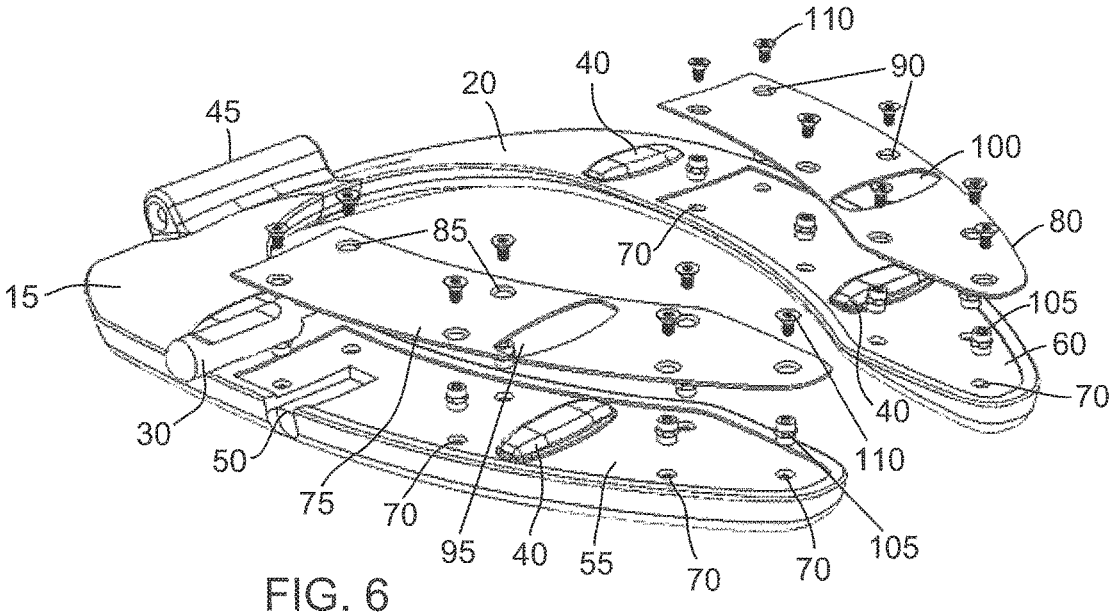
FIG. 6 is a view to illustrate the arrangement and connection of the components of the toilet seat of the invention.

This connection is best shown in FIG. 6 where in all components of the toilet seat 10 are illustrated in an exploded arrangement. The handle 30 and slot 50 are illustrated with protective plate member 75 positioned to be attached to right side U-shaped portion 15 in recess 55. Also shown are the holes 70 in the recess 55 of the U-shaped portion 15 which receives inserts 105 which in turn receive bolts 110 that pass through holes 85 and into inserts 105. The bolt heads are wider than the holes 85 so that they can hold the plate member 75 in the recess, securing the handle member rearward portion 35 in slot 50. As noted herein, the security heads of the bolts require special tools for attaching the bolts 110 to the inserts 105. The same is true for the attachment of balancing plate member 80 into recess 60 using inserts 105 in holes 70 and bolts 110. This results in a secure connection of the plate members to the seat support to prevent accidental or intentional removal as well as to prevent or resist damage to the handle which would interfere with its appropriate function. And all of the bolts would have the same security head to facilitate installation by authorized personnel.

A preferred feature of the invention is the use of the protective plate member to prevent contact of the handle 25 with the upper surface of the toilet bowl to prevent germs from directly contacting the handle. The protective and balancing plate members also prevent splashes of human waste or other liquids or solids from the bowl from contacting the lower surface of the seat support where they could grow and migrate toward and upon the handle. Materials such as stainless steel or copper alloys prevent germ growth on the plate member surfaces to provide further protection. The handle thus remains relatively germ free or at least significantly reduced in germ contamination so that it is more sanitary when used to lift or lower the seat.

Therefore, in sum, it is to be realized that the optimum dimensional relationships for the parts of the invention can include variations and tolerances in size, materials, shape, form, function and use are deemed readily apparent and obvious to the skilled artisan, and all equivalent relationships to those illustrated in the drawings and described in the specification are intended to be encompassed by the claims appended hereto.

Unless defined otherwise, all technical and scientific terms used herein have same meaning as commonly understood by one of ordinary skill in the art to which this invention belongs. Also, as used herein and in the appended claims, the singular form "a", "and", and "the" include plural referents unless the context clearly dictates otherwise. All technical and scientific terms used herein have the same meaning.

The foregoing detailed description is considered as illustrative only of the principles of the invention. Further, since numerous modifications and changes will readily be apparent to those having ordinary skill in the art, it is not desired to limit the invention to the exact constructions demonstrated. Accordingly, all suitable modifications and equivalents may be resorted to falling within the scope of the invention.

What is claimed is:

1. A toilet seat comprising:

a seat support having a top surface and a lower surface and configured to be mounted on a toilet bowl, wherein the lower surface comprises a slot and a recess, wherein the slot extends into the recess;

a lifting mechanism securely attached to the lower surface of the seat support, with the lifting mechanism comprising a handle member that has a rearward portion that is received in the slot and a forward portion that extends outside of the slot, wherein the forward portion is cylindrical and includes a forward end that is rounded and chamfered to facilitate lifting or lowering of the seat;

a protective plate member configured and arranged to fit in the recess subjacent the rearward portion of the handle member and extending on both sides thereof to secure the handle member to the seat support;

a fastening system for attaching the protective plate member to the lower surface of the seat support with the rearward portion of the handle member situated between the seat support and the protective plate member; and two or more seat bumpers that minimize contact of the lower surface of the seat support with the toilet bowl.

2. The toilet seat of claim 1, wherein the fastening system comprises a plurality of screws or rivets; adhesives; a plurality of inserts securely mounted in the seat support and threaded bolts or screws that are received in the inserts; a plurality of threaded bolt shanks projecting from the lower surface of the support and received in openings in the protective plate member and being secured thereto by nuts; welding or another bonding system; hook and loop components, with one attached to the support and one attached to the protective plate member; or spikes or teeth in the protective plate member that are embedded in the seat support.

3. The toilet seat of claim 1, wherein the protective plate member and handle member are independently made of metal, an impermeable engineered plastic, treated wood, or a composite material.

4. The toilet seat of claim 1, wherein the seat support has a substantially U-shaped configuration, or a full or partial substantially circular or oval shape.

5. A toilet seat comprising:

a seat support having a top surface and a lower surface and configured to be mounted on a toilet bowl;

a lifting mechanism securely attached to the lower surface of the seat support, with the lifting mechanism comprising a handle member that has a rearward portion that is received in the seat support and a forward portion that extends outside of the seat support to facilitate lifting or lowering of the seat, a protective plate member configured and arranged to fit below or within the lower surface of the seat support subjacent the rearward portion of the handle member and extending on both sides thereof to secure the handle member to the seat support, wherein the protective plate member covers at least about 15% to about 50% of the lower surface of the seat support;

a balancing plate member that also covers at least about 15% to about 50% of the lower surface of the seat support in an opposed location to the protective plate member so that the seat has a balanced weight to facilitate lifting;

a fastening system for attaching the protective plate member to the lower surface of the support with the rearward portion of the handle member situated between the seat support and the protective plate member; and two or more seat bumpers that minimize contact of the lower surface of the seat support with the toilet bowl.

6. The toilet seat of claim 5, wherein the protective plate member and the balancing plate member each cover at least about 25% to 50% of the lower surface of the seat support.

7. The toilet seat of claim 1, wherein the protective plate member has a thickness of between about 0.1 and about 0.35 inches wherein when the protective plate member is made of metal the thickness is between about 0.1 and about 0.25 inches and when the protective plate member is made of plastic, the thickness is between about 0.2 and about 0.35 inches.

8. The toilet seat of claim 1, wherein the handle member and protective plate member are each made of metal, and the forward portion of the handle member is configured and dimensioned to be larger than the rearward portion to facilitate grasping and lifting of the seat.

9. The toilet seat of claim 8, wherein the protective plate member is made of plastic and is adhered to the lower surface of the seat support with the rearward portion of the handle member positioned in the slot between the plate member and seat support.

10. The toilet seat of claim 1, wherein the seat bumpers are attached to the seat support and the protective plate member has apertures therein that are sufficiently large to surround each seat bumper to allow each seat bumper to protrude through the plate member.

11. The toilet seat of claim 1, wherein the protective plate member includes the seat bumpers mounted thereon in spaced relation.

12. A toilet seat comprising:

a seat support having a top surface and a lower surface and configured to be mounted on a toilet bowl;

a lifting mechanism securely attached to the lower surface of the seat support, with the lifting mechanism comprising a handle member that has a rearward portion that is received in the seat support and a forward portion that extends outside of the seat support to facilitate lifting or lowering of the seat, a protective plate member configured and arranged to fit below or within the lower surface of the seat support subjacent the rearward portion of the handle member and extending on both sides thereof to secure the handle member to the seat support;

a fastening system for attaching the protective plate member to the lower surface of the support with the rearward portion of the handle member situated between the seat support and the protective plate member; and two or more seat bumpers that minimize contact of the lower surface of the seat support with the toilet bowl, wherein the fastener system comprises a plurality of inserts securely mounted in openings in the support and threaded bolts or screws that are received in the inserts with the bolts or screws configured to secure the plate members to the seat support.

13. The toilet seat of claim 1, wherein the lower surface of the seat support and protective plate member are substantially flat.

14. The toilet seat of claim 1, wherein the lower surface of the seat support has a curvature and the protective plate member has a curvature that corresponds to the curvature of the lower surface of the seat support.

15. The toilet seat of claim 1, wherein each of the recess and protective plate member is configured and dimensioned to conform to the entire lower surface of the seat support.

16. A toilet seat comprising:

a U-shaped seat support having a top surface and a lower surface and configured to be mounted on a toilet bowl;

a lifting mechanism securely attached to the lower surface of the seat support, with the lifting mechanism comprising a handle member that has a rearward portion that is received in a slot or channel in the lower surface of the seat support and a forward portion that extends outside of the seat support to facilitate grasping and lifting of the seat, and a protective plate member configured and arranged to fit below or within the lower surface of the seat support subjacent the rearward portion of the handle member and extending on both sides thereof to secure the handle member to the seat support, wherein the lower surface of the seat support includes a recess having a raised wall for receiving the protective plate member therein, with the protective plate member and recess covering at least about 25% to 50% of the lower surface of the support extending from one end of the U-shaped support, with the slot or channel in the support located above the recess, and with the forward portion of the handle member configured and dimensioned to be larger than the rearward portion;

a balancing plate member that also covers at least about 25% to 50% of the lower surface of the seat support in an opposed location to the protective plate member and extending from the other one end of the U-shaped support, wherein the lower surface of the seat support includes a recess having a raised wall for receiving the balancing plate member therein, so that the seat has a balanced weight to facilitate lifting;

a plurality of inserts securely mounted in the support and threaded bolts or screws that are received in the inserts with the bolts or screws configured to secure the plate members to arms of the seat support; and two or more seat bumpers that minimize contact of the lower surface of the seat support with the toilet bowl.

17. The toilet seat of claim 16, wherein the balancing and protective plate members include one or more apertures therein that are sufficiently large to surround each seat bumper to allow each seat bumper to protrude through the plate member and wherein the handle member, protective plate and balancing plate are made of metal.

18. The toilet seat of claim 5, wherein each of the protective plate member and balancing plate member has a thickness of between about 0.1 and about 0.35 inches wherein when the members are made of metal the thickness of each is between about 0.1 and about 0.25 inches and when the members are made of plastic, the thickness of each is between about 0.2 and about 0.35 inches.

19. The toilet seat of claim 5, wherein at least one seat bumper is attached to the seat support and the protective plate member or balancing plate member or each are made of metal and have one or more apertures therein that are sufficiently large to surround each seat bumper to allow each seat bumper to protrude through the protective or balancing plate member(s).

20. The toilet seat of claim 5, wherein the protective plate member, the balancing plate member or each are made of metal and include at least one seat bumper mounted thereon.

* * * * *